US007426360B2

(12) United States Patent
Arimoto et al.

(10) Patent No.: US 7,426,360 B2
(45) Date of Patent: Sep. 16, 2008

(54) DEVELOPING APPARATUS

(75) Inventors: Kota Arimoto, Abiko (JP); Shigeru Tanaka, Toride (JP); Shinya Suzuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 326 days.

(21) Appl. No.: 11/193,398

(22) Filed: Aug. 1, 2005

(65) Prior Publication Data

US 2006/0029432 A1 Feb. 9, 2006

(30) Foreign Application Priority Data

Aug. 6, 2004 (JP) ..... 2004-231745

(51) Int. Cl.
*G03G 15/08* (2006.01)

(52) U.S. Cl. ..... 399/254; 399/119; 399/120

(58) Field of Classification Search ..... 399/107, 399/119, 120, 252, 254, 258, 260, 262; 222/DIG. 1
See application file for complete search history.

(56) References Cited

U.S. PATENT DOCUMENTS

| | | | | |
|---|---|---|---|---|
| 4,768,055 | A * | 8/1988 | Takamatsu et al. | 399/102 |
| 5,614,996 | A * | 3/1997 | Tanda | 399/120 |
| 6,324,369 | B1 * | 11/2001 | Yamaguchi et al. | 399/254 |
| 6,415,125 | B1 | 7/2002 | Yamamoto et al. | |
| 6,421,516 | B1 * | 7/2002 | Kinoshita et al. | 399/254 |
| 6,763,214 | B2 * | 7/2004 | Sugihara | 399/254 |
| 7,039,344 | B2 * | 5/2006 | Nishiyama | 399/254 |
| 7,046,945 | B2 | 5/2006 | Nishitani et al. | |
| 7,263,315 | B2 * | 8/2007 | Tanaka et al. | 399/254 |
| 7,356,288 | B2 * | 4/2008 | Iwata et al. | 399/254 |
| 2004/0076452 | A1 | 4/2004 | Nishitani et al. | |
| 2005/0002700 | A1 * | 1/2005 | Nishitani | 399/258 |

(Continued)

FOREIGN PATENT DOCUMENTS

| | | |
|---|---|---|
| JP | 55-32060 | 3/1980 |

(Continued)

OTHER PUBLICATIONS

Japanese Office Action dated Apr. 10, 2008 in Japan Patent Application No. 2004-231745, along with partial English-language translation.

(Continued)

*Primary Examiner*—Hoan H Tran
(74) *Attorney, Agent, or Firm*—Fitzpatrick, Cella, Harper & Scinto

(57) ABSTRACT

A developing apparatus includes a developer carrying member for carrying thereon and conveying a developer to a portion opposed to an image bearing member; a first chamber having the developer carrying member disposed in an opening thereof; a conveying member disposed in the first chamber for conveying the developer; a second chamber to which the developer is supplied from the first chamber through a first communicating portion and which supplies the developer to the first chamber through a second communicating portion to the first chamber; an agitating and conveying member disposed in the second chamber and rotatable to thereby agitate and convey the developer, wherein the second chamber and the agitating and conveying member are disposed while being inclined with respect to a horizontal direction; and developer supplying means for supplying a developer to be supplied, from just above an area of the second chamber.

3 Claims, 10 Drawing Sheets

U.S. PATENT DOCUMENTS

| | | | | |
|---|---|---|---|---|
| 2005/0031381 | A1 | 2/2005 | Arimoto | 399/258 |
| 2006/0029431 | A1 | 2/2006 | Tanaka et al. | 399/254 |

FOREIGN PATENT DOCUMENTS

| | | | |
|---|---|---|---|
| JP | 2-64584 | A | 3/1990 |
| JP | 7-253711 | A | 10/1995 |
| JP | 10-149024 | A | 6/1998 |
| JP | 11-119540 | A | 4/1999 |
| JP | 2001-92251 | A | 4/2001 |
| JP | 2003-5519 | | 1/2003 |
| JP | 2004-133339 | A | 4/2004 |

OTHER PUBLICATIONS

Japanese Office Action dated Sep. 3, 2007 in Japan Patent Application No. 2004-231745, along with English-language translation.

* cited by examiner

DEVELOPING APPARATUS

BACKGROUND OF THE INVENTION

1. Field of the Invention

The invention relates to a developing apparatus in an image forming apparatus using an electrophotographic process such as a copying machine, a printer or a facsimile apparatus.

2. Related Background Art

In image forming apparatuses using, for example, an electrophotographic process, and above all, image forming apparatuses effecting color image formation, there has heretofore been widely utilized a two-component developing method using a mixture of a nonmagnetic toner (toner) and a magnetic carrier (carrier) as a developer. The two-component developing method, as compared with other developing methods presently proposed, has such merits as the stability of the quality of image and the durability of the apparatus.

In a developing apparatus using the two-component developing method (two-component developing apparatus), as the toner is supplied to an image bearing member to thereby effect development, toner density (the rates of the toner and the carrier, or the rate of the toner to the entire developer) in the developer is gradually reduced. To prevent this reduction in toner density, it is necessary to supply a fresh toner. When the toner is supplied, a two-component developer including also a carrier is sometimes supplied.

FIG. 12 of the accompanying drawings shows a conventional popular two-component developing apparatus. As prior art literature regarding such a two-component developing apparatus, mention may be made, for example, of Japanese Patent Application Laid-Open No. S55-32060.

The developing apparatus 201 has a developer container 202 containing a developer therein. A portion of the developer container 202 which is opposed to an image bearing member which is a member to be developed opens. A developing sleeve 211 as a developer carrying member for supplying the developer to the image bearing member is rotatably disposed in such a manner as to be partly exposed from this opening portion. The developer container 202 has a developing chamber (first developer containing chamber) 221 and an agitating chamber (second developer containing chamber) 222. The developing chamber 221 is disposed along the axial direction of the developing sleeve 211, and the developer contained therein is supplied to the developing sleeve 211. In the agitating chamber 222, a supplied toner and the developer in the developer container 202 are mixed together and agitated, and are conveyed in a direction opposite to the developing chamber 221. The developing chamber 221 and the agitating chamber 222 are comparted by a partition wall 225. However, the longitudinal opposite end portions of the partition wall 225 are formed with a first communicating path (connecting portion) 223 and a second communicating path (connecting portion) 224 permitting the passage of the developer. A first screw 213 and a second screw 214 as conveying members (developer conveying and agitating members) which effect the conveyance and agitation of the developer are disposed in the developing chamber 221 and the agitating chamber 222, respectively. Thereby, there is formed a developer circulating route (in a direction indicated by the arrow D in FIG. 12) in which the developer circulates between the developing chamber 221 and the agitating chamber 222, through the first communicating path 223 and the second communicating path 224.

A toner supplying port for supplying the toner is provided in the developer container 202. The toner supplied into the developer container 202 usually by the fall by gravity at a toner supplying position T is agitated with the developer in the developer container 202, in the agitating chamber 222. Thereby, the supplied toner contacts with a carrier and is frictionally charged.

However, when the agitation in the agitating chamber 222 is insufficient, the developer is conveyed from the first communicating path 223 to the developing chamber 221 while the supplied toner remains not sufficiently charged. If this insufficiently charged toner is used for the developing operation, toner fog may occur in an image blank portion (an area on the image bearing member to which the toner originally should not adhere), thus resulting in the lowering of the dignity of image.

In order to prevent such toner fog, in the conventional developing apparatus 201, it is ordinary to suitably set the distance from the toner supplying position T in the agitating chamber 222 to the first communicating path 223 (hereinafter referred to as the "agitating distance") L1. In this case, however, the longitudinal distance of the developer circulating route (i.e., the length of the developing chamber 221 and the agitating chamber 222 in the axial direction (longitudinal direction) of the developing sleeve 211: hereinafter referred to also as the "longitudinal conveying distance") L2 often becomes long. This becomes a factor which binders the downsizing of the developing apparatus 201, and further the downsizing of the entire image forming apparatus.

Due to the rise of needs for color images in recent years, also in image forming apparatuses for effecting color image formation, the downsizing of the apparatus has come to be required together with the lower cost of the apparatus.

The minimum longitudinal length required of the longitudinal conveying distance L2 in the agitating chamber 222 is nothing but the width of an electrostatic image formed on the image bearing member in a direction substantially along the longitudinal direction of the developer circulating route, i.e., a developing area (hereinafter referred to as the "image formable width") A. That is, it will be good if the developer is supplied onto the developing sleeve 211 by a width corresponding to the image formable width A. Usually, the image formable width A substantially corresponds to an axial (longitudinal) length by which the developing sleeve 211 holds the developer thereon.

Now, Japanese Patent Application Laid-Open No. 2003-5519 discloses a construction as shown in FIGS. 13 and 14 of the accompanying drawings wherein a second screw 327 is provided while being inclined with respect to a first screw 326. In a developing apparatus described in Japanese Patent Application Laid-Open No. 2003-5519, a developer falling space 334 for a developer conveyed by the first screw 326 to fall toward the second screw 327 is formed between the downstream side end portion of the first screw 326 with respect to a developer conveying direction and the upstream side end portion of the second screw 327 with respect to the developer conveying direction. Also, an inclined surface 335 for guiding the developer to the second screw 327 is provided below the developer falling space 334. The developer and the supplied toner fall onto the inclined surface 335 through the developer falling space 334. Then, the developer and the supplied toner are superposed upon each other and agitated, and slide on the inclined surface 335 and are conveyed to the upstream side end portion of the second screw 327 with respect to the developer conveying direction. Thereby, an attempt is made to improve the introducing performance of the supplied toner which will be described later.

However, in the developing apparatus described in Japanese Patent Application Laid-Open No. 2003-5519, in order to sufficiently charge the supplied toner from the second screw 327 to the first communicating path for delivering the developer to the first screw 326, the agitating distance L1 becomes longer than the image formable width A, and as a matter of course, the longitudinal conveying distance L2 in the agitating chamber also becomes longer than the image formable width A and thus, the developing apparatus becomes unnecessarily large.

Also, in the developing apparatus described in Japanese Patent Application Laid-Open No. 2003-5519, the supplied toner is made to fall into the developer falling space 334 formed in the lower portion of the first screw 327. Therefore, there is little or no developer near the first screw 326 right beneath the toner supplying port 336. As a result, it becomes impossible to stably supply the developer to the developing sleeve 325, and in this area, toner development cannot be effected. Accordingly, the longitudinal conveyed distance L2 in the agitating chamber becomes longer by at least a distance corresponding to the length of the developer falling space 334 than the image formable width A.

Further, in the developing apparatus described in Japanese Patent Application Laid-Open No. 2003-5519, the supplied toner falls onto the rotating first screw 326. Therefore, the supplied toner scatters in the upstream direction of the first screw 326 with respect to the developer conveying direction, and a back flow phenomenon is considered to occur. This back-flowing supplied toner is not sufficiently charged and therefore, if it is conveyed onto the developing sleeve 326, toner fog occurs to the image blank portion. Therefore, in the developing apparatus described in Japanese Patent Application Laid-Open No. 2003-5519, the longitudinal conveying distance L2 becomes longer than necessary, (than the image formable width A or more) by the length of the developer falling space 334, plus the distance of counter flow of the supplied toner.

SUMMARY OF THE INVENTION

It is the object of the present invention to provide a developing apparatus which is compact and can enhance the charge imparting capability of a supplied toner.

A preferred developing apparatus for achieving the above object has:

a developer carrying member for carrying thereon and conveying a developer including a toner and a carrier to a portion opposed to an image bearing member;

a first chamber having the developer carrying member disposed in an opening thereof;

a conveying member disposed in the first chamber for conveying the developer in the longitudinal direction of the developer carrying member;

a second chamber to which the developer is supplied from the first chamber through a first communicating portion leading to the first chamber and which supplies the developer to the first chamber through a second communicating portion leading to the first chamber;

an agitating and conveying member disposed in the second chamber and rotatable to thereby agitate and convey the developer, wherein the second chamber and the agitating and conveying member are disposed while being inclined with respect to a horizontal direction so that the second communicating portion side may be higher than the first communicating portion side, and wherein the first communicating portion side of the first chamber is higher than the first communicating portion side of the second chamber; and developer supplying means for supplying a developer to be supplied, through a supply opening provided in the upper portion of an area of the second chamber to which the developer is supplied from the first communicating portion.

DESCRIPTION OF THE PREFERRED EMBODIMENTS

A developing apparatus according to the present invention will hereinafter be described in greater detail with reference to the drawings.

Embodiment 1

[General Construction and Operation of an Image Forming Apparatus]

Figure 1:
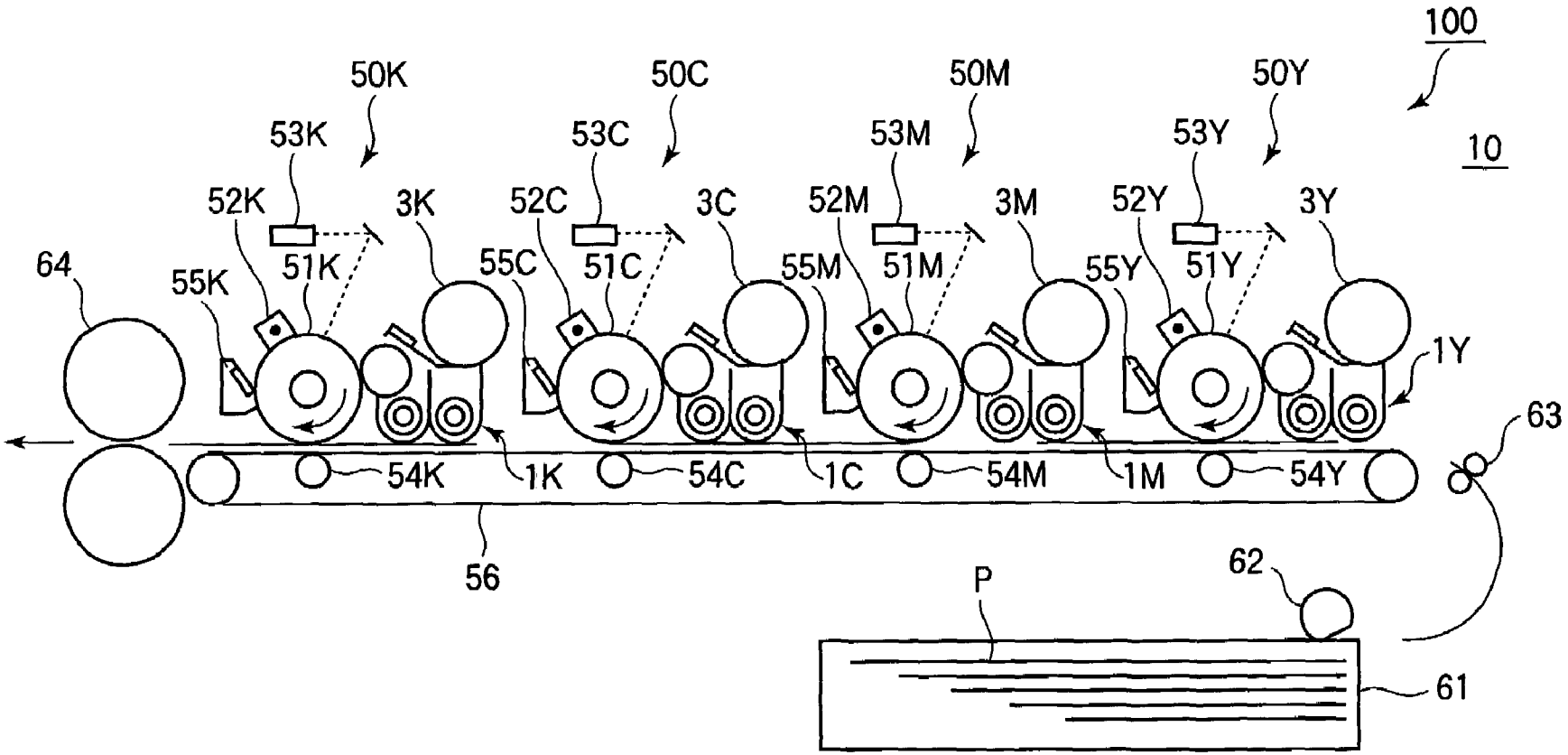
FIG. 1 is a schematic cross-sectional view of an example of an image forming apparatus to which the present invention is applicable.

Reference is first had to FIG. 1 to describe the general construction and operation of an embodiment of an image forming apparatus to which the present invention is applied. FIG. 1 schematically shows a cross section of an embodiment of the image forming apparatus 100 to which the present invention is applied.

The image forming apparatus 100 according to the present embodiment is a color electrophotographic image forming apparatus provided with four image forming portions 50Y, 50M, 50C and 50K as a plurality of image forming means for forming yellow (Y), magenta (M), cyan (C) and black (K) images, respectively. The image forming apparatus 100 can form a color image on a recording material P in accordance with an image information signal from an external host device such as a personal computer communicably connected to an image forming apparatus main body 10, or an image reading apparatus belonging to or communicably connected to the image forming apparatus main body 10.

The operation of the image forming apparatus 100 will first be described. In the present embodiment, the image forming portions 50Y, 50M, 50C and 50K provided in the image forming apparatus 100 have basically the same constructions, and differ in the color of images formed thereby from one another. Accordingly, hereinafter, unless distinction is particularly required, the suffices Y, M, C and K given to the reference numerals in FIG. 1 in order to indicate that the image forming portions are factors for the respective colors will be omitted, and description will be made in the gross.

The image forming portion 50 has as an image bearing member a drum-shaped electrophotographic photosensitive member (hereinafter referred to as the "photosensitive drum") 51 rotatable in the direction indicated by the arrow in FIG. 1. During image formation, the surface of the photosensitive drum 51 being rotated is first charged by a primary charger 52 as charging means. The charged surface of the photosensitive drum 51 is scanned and exposed in accordance with a color-resolved image information signal corresponding to each image forming portion 50 by a laser scanner 53 as image writing means (exposing means) Thereby, an electrostatic image according to the image information signal of a corresponding color is formed on the photosensitive drum 51. Then, this electrostatic image is developed with a toner by a developing apparatus 1, and a toner image is formed on the photosensitive drum 51.

A conveying belt 56 as recording material conveying means is disposed for endless movement in opposed relationship with the photosensitive drum 51 of the image forming portion 50. A transfer charger 54 as transferring means is provided at a location opposed to the photosensitive drum 51 of the image forming portion 50 with the conveying belt 56 interposed therebetween. The toner image formed on the photosensitive drum 51 in the manner described above is transferred onto a recording material P on the conveying belt 56 by a transfer bias applied by the transfer charger 54.

The recording material P is conveyed from a cassette 61 which is a recording material containing portion to registration rollers 63 by recording material supplying means such as a pickup roller 62. Then, the recording material P is fed to the conveying belt 56 in synchronism with the image forming operation of the image forming portion 50 by the registration rollers 63.

When for example, a full-color image is to be formed, the image forming operation as described above is performed in each of the yellow, magenta, cyan and black image forming portions 50. Thereby, toner images are successively transferred onto the recording material P conveyed on the conveying belt 56, whereby a desired full-color image is formed on the recording material P. During the formation of a monochromatic image, use is made of only the image forming portion for forming a desired color, whereby a toner image can be likewise formed on the recording material P.

Thereafter, the recording material P is separated from the conveying belt 56 and is conveyed to a fixing apparatus 64. The toner image transferred onto the recording material P is pressurized and heated by the fixing apparatus 64, and thereby becomes a permanent image. Also any untransferred toner residual on the photosensitive drum 51 after the transfer is removed by a cleaning apparatus 55 as cleaning means, and the photosensitive drum 51 becomes ready for the next image formation. The cleaning apparatus 55 has a blade-shaped cleaning member.

[Developing Apparatus]

The developing apparatus 1 will now be described with reference to FIGS. 2 and 3.

The developing apparatus 1 has a developer container 2 containing a developer therein. A two-component developer including chiefly a nonmagnetic toner (toner) and a magnetic carrier (carrier) as a developer is contained in the developer container 2.

The developer container 2 opens at a portion opposed to the photosensitive drum 51, and a developing sleeve 11 as a developer carrying member is rotatably disposed in such a manner as to be partly exposed in this opening portion. The developing sleeve 11 is formed of a nonmagnetic material and includes a stationary magnet 12 as magnetic field generating means therein. In the present embodiment, the magnet 12 has a plurality of magnetic poles along the outer periphery thereof. During a developing operation, the developing sleeve 11 is rotated in the direction indicated by the arrow in FIG. 2, and holds thereon the two-component developer in the developer container 2 in a layer shape, and carries and conveys the developer to a developing area opposed to the photosensitive drum 51. The developer carried on the developing sleeve 11 forms an magnetic brush standing like the ears of rice in the developing area. This magnetic brush is brought into contact with or proximity to the surface of the photosensitive drum 51. Thereby, in accordance with the electrostatic image formed on the surface of the photosensitive drum 51, the toner in the two-component developer is supplied to the photosensitive drum 51 side, whereby the electrostatic image is developed.

Usually, at least during the developing operation, a predetermined developing bias is applied to the developing sleeve 11, and by the action of an electric field formed between the photosensitive drum 51 and the developing sleeve 11, the toner is shifted to the photosensitive drum 51. Also, in order to regulate the amount of developer carried on the developing sleeve 11, a developer amount regulating member 18 is provided upstream of the developing area with respect to the rotation direction of the developing sleeve 11. The developer amount regulating member 18 cooperates with the magnet 12 to regulate the thickness of a developer layer by the action of a magnetic field.

The developer after having developed the electrostatic image on the photosensitive drum 51 is conveyed in accordance with the rotation of the developing sleeve 11, and is collected into the developing chamber (first developer containing chamber) 21 of the developer container 2 which will be described later.

The developer container 2 is substantially divided into two, i.e., the developing chamber (first developer containing chamber) 21 (a side near to the developing sleeve 11) and an agitating chamber (second developer containing chamber) 22 (a side far from the developing sleeve 11), by a partition wall 25. The partition wall 25 does not reach the side walls 26 and 27 of the longitudinal opposite end portions of the interior of the developer container 2, whereby there are formed connecting portions permitting the passage of the developer between the developing chamber 21 and the agitating chamber 22, i.e., a first communicating path (connecting portion) 23 and a second communicating path (connecting portion) 24 through which the delivery of the developer is effected.

Circulating means for circulating the developer between the developing chamber 21 and the agitating chamber 22 is provided in the developing chamber 21 and the agitating chamber 22. This circulating means has a first screw 13 and a second screw 14 as conveying members for effecting the conveyance and agitation of the developer, along the direction of the longitudinal axes of the developing chamber 21 and the agitating chamber 22. The developer is circulated in the developer container 2 while being mixed and agitated-by the first and second screws 13 and 14. The direction of circulation of the developer in the developing apparatus 1 according to the present embodiment is a direction from the inner part side toward this side of the plane of the drawing sheet of FIG. 2 in the developing chamber 21, and a direction from this side toward the inner part side of the plane of the drawing sheet of FIG. 2 in the agitating chamber 22 (the direction indicated by the arrow D in FIG. 3).

Also, above the agitating chamber 22 of the developer container 2, there is provided a developer supplying port 28 connected to a developer cartridge 5 containing therein a developer to be supplied containing at least a toner. An amount of toner consumed by image formation is supplied into the developer container 2 from a toner cartridge 3 through the developer supplying port 28 by the rotation of an agitating member (not shown) in the toner cartridge 3 and by the gravity. The toner supply amount is found on the basis of toner consumption amount information or the like calculated (integrated) from density information for each pixel based on, for example, the detection signal of a reflection type optical sensor 19 provided in the developing apparatus 1, or an image information signal for each color. In accordance with the thus found toner supply amount, a necessary amount of toner is suitably supplied to the developer container 2.

Here, description will be made of the two-component developer used in the present embodiment. As described above, the two-component developer including chiefly the nonmagnetic toner (toner) and the magnetic carrier (carrier) is contained in the developing apparatus 1. The toner density in the developer in its initial state is 7% by weight. This value, however, should be properly adjusted depending on the charge amount of the toner, the particle diameter of the carrier, the construction of the image forming apparatus, etc., and need not always be restrictive.

The toner has coloring resin particles including a binding resin, a colorant, and other additive as required, and coloring particles to which an extraneous additive like colloidal silica fine powder is extraneously added. As the toner, use can be suitably made of one manufactured, for example, by a crushing method by the use of negatively chargeable polyester resin. Also, it is preferable that the volume average particle diameter of the toner be 5 or greater and 9 μm or less. In the present embodiment, it was 7.2 μm.

Also, as the carrier, use can be suitable made, for example, of a metal such as surface-oxidated or unoxidated iron, nickel, cobalt, manganese, chromium or rare earth, or an alloy thereof, or oxide ferrite or the like. A method of manufacturing these magnetic particles is not particularly limited. The carrier has a weight average particle diameter of 20-50 μm, and preferably 30-40 μm, and resistivity of $10^7$ Ωcm or greater, and preferably $10^8$ Ωcm or greater. In the present embodiment, a carrier of $10^8$ Ωcm was used.

[Circulation Route of the Developer]

Description will now be made in detail of a developer circulation route and a toner supplying position which are the features of the present embodiment.

Figure 2:
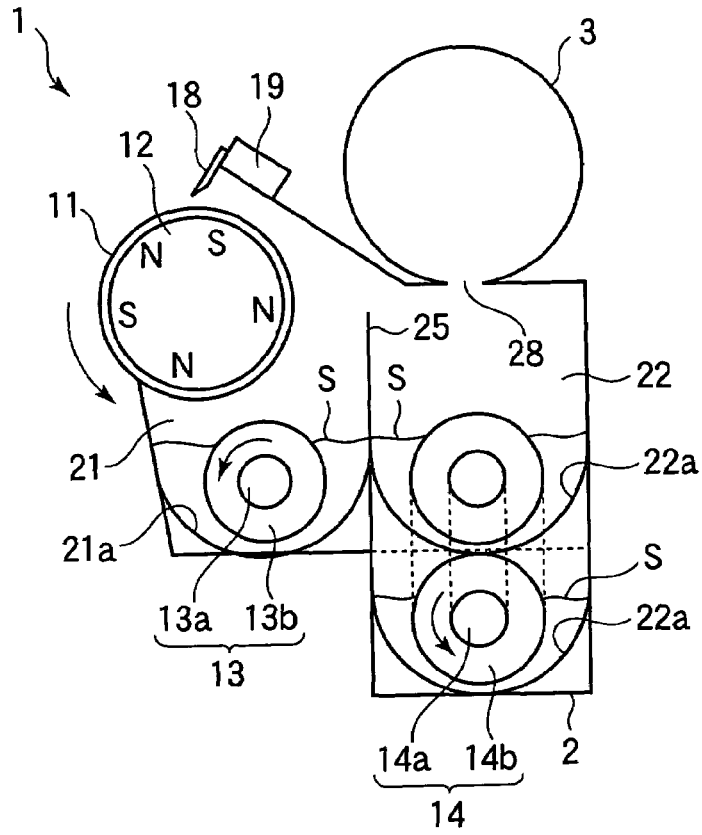
FIG. 2 is a schematic cross-sectional view of an embodiment of a developing apparatus according to the present invention.
Figure 3:
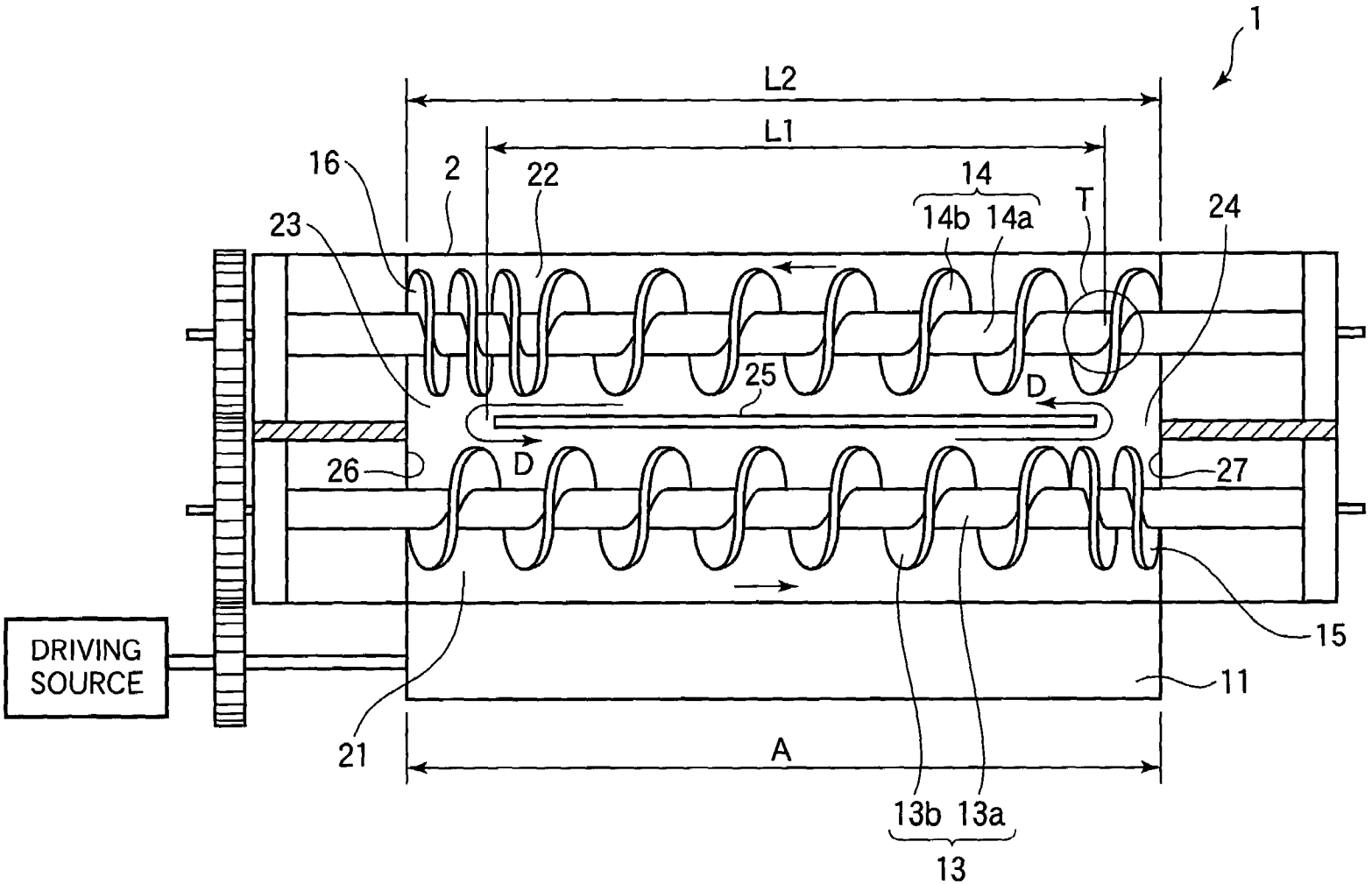
FIG. 3 is a top plan view of the embodiment of the developing apparatus according to the present invention.

Referring to FIGS. 2 and 3, in the present embodiment, the first screw 13 and the second screw 14 have rotary shafts 13*a* and 14*a*, respectively, provided substantially in parallelism to the longitudinal axial direction of the developing chamber 21 and the agitating chamber 22, and spiral conveying portions (wing portions and spiral members) 13*b* and 14*b*, respectively, provided around them.

The first and second screws 13 and 14 are such that the diameters of the rotary shafts 13*a* and 14*a* thereof are 6 mm. The spiral conveying portions 13*b* and 14*b* having a diameter (the diameter of a circumscribed circle formed by the rotation of the conveying portions 13*b* and 14*b* when viewed in the direction of the rotary shafts) of 16 mm are disposed at an interval of 15 mm in the direction of the rotary shafts on the peripheral surfaces of the shafts. Also return members 15 and 16 are provided on the downstream end portions of the first and second screws 13 and 14 with respect to a developer conveying direction, whereby the developer is forced back in a direction opposite to the developer conveying direction to thereby smooth the delivery of the developer in the first and second communicating paths 23 and 24. In the present embodiment, the first screw 13 and the second screw 14 are rotated in a counter-clockwise direction as viewed in FIG. 2.

In the developing apparatus 1 according to the present embodiment, the agitating chamber 22 (more particularly the bottom surface (bottom portion) 22*a* of the agitating chamber 22) is upwardly inclined from the upstream side toward the downstream side with respect to the developer conveying direction by 5 degrees relative to a horizontal direction (upwardly gradient from the second communicating path 24 side toward the first communicating path 23 side). The rotary shaft 14*a* of the second screw 14 is disposed substantially parallel to the bottom surface 22*a* of the agitating chamber 22, and is disposed in the agitating chamber 22 with an inclination of 5 degrees relative to the horizontal direction (upward gradient from the upstream side toward the downstream side with respect to the developer conveying direction).

On the other hand, in the present embodiment, the developing chamber 21 (more particularly the bottom surface (bottom portion) 21*a* of the developing chamber 21) is disposed in a substantially horizontal direction, i.e., substantially parallel to the developing sleeve 11, for the stable supply of the developer to the entire longitudinal area of the developing sleeve 11. The rotary shaft 13*a* of the first screw 13 is disposed substantially parallel to the bottom surface 21*a* of the developing chamber 21, i.e., disposed substantially horizontally.

Usually, the agitating chamber 22 and the rotary shaft 14*a* of the second screw 14 are disposed substantially parallel to each other, and the angle formed between the agitating chamber 22 and the horizontal and the angle formed between the second screw 14 and the horizontal are the same. Accordingly, these will hereinafter be generically referred to as "the inclination of the agitating chamber".

Herein, the orientation of the elements of the developing apparatus, for example, the developing chamber 21, the agitating chamber 22, etc., when contrasted with the horizontal direction (or a vertical direction orthogonal thereto), is that in the ordinary used state of the developing apparatus 1 (developer container 2) and the image forming apparatus 100. Typically, in the ordinary used state of the developing apparatus 1 (developer container 2) and the image forming apparatus 100, the longitudinal axial direction of the developing apparatus 1 (developer container 2) as a whole (the longitudinal axial direction of the developing sleeve 11) corresponds to the horizontal direction. However, it does not mean being strictly horizontal, but may deviate from the horizontal to such a degree that there is no problem in the ordinary use of the developing apparatus 1 (developer container 2) and the image forming apparatus 100.

In the present embodiment, the communicating path, i.e., the second communicating path 24, through which the developer is delivered from the downstream end portion of the developing chamber 21 with respect to the developer conveying direction to the upstream end portion of the agitating chamber 22 with respect to the developer conveying direction, has a portion overlapping the area of the electrostatic image formed on the photosensitive drum 51, in the axial direction of the developing sleeve 11. Further, in the present embodiment, the communicating path i.e., the first communicating path 23, through which the developer is delivered from the downstream end portion of the agitating chamber 22 with respect to the developer conveying direction to the upstream end portion of the developing chamber 21 with respect to the developer conveying direction, has a portion overlapping the area of the electrostatic image formed on the photosensitive drum 51, in the axial direction of the developing sleeve 11.

That is, in the present embodiment, the length (longitudinal conveying distance) L2 of the developing chamber 21 and the agitating chamber 22 in the axial direction of the developing sleeve 11 is substantially equal to the length (maximum image formable width) A of the maximum area of the electrostatic image formable on the photosensitive drum 51 in the same direction. Here, the longitudinal conveying distance L2 and the image formable width A are substantially equal to each other, namely, 305 mm.

In the present embodiment, in the first communicating path 23 through which the developer is delivered from the agitating chamber 22 to the developing chamber 21, the bottom surface 22*a* of the agitating chamber 22 and the bottom surface 21*a* of the developing chamber 21 are at the vertically same position. On the other hand, in the second communicating path 24 through which the developer is delivered from the developing chamber 21 to the agitating chamber 22, the bottom surface 22*a* of the agitating chamber 22 is at a vertically lower position than the bottom surface 21*a* of the developing chamber 21, and the developer surface S in the agitating chamber 22 is below the bottom surface 21*a* of the developing chamber 21. Here, the developer surface S means an interface which the developer contained in the developer container 2 forms with the internal space of the developer container 2.

Figure 4:
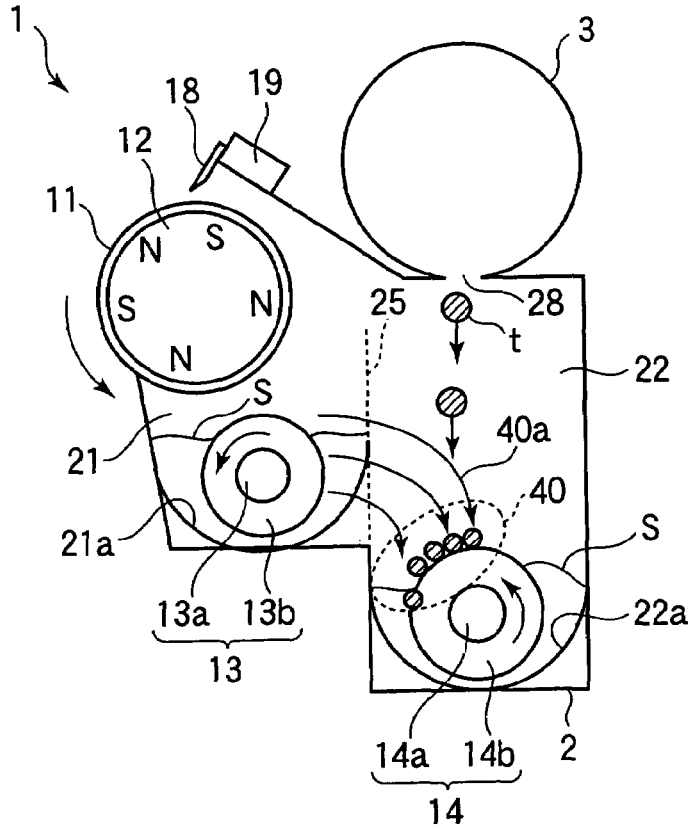
FIG. 4 is a vertical cross-sectional view of the developing apparatus in a second communicating path for illustrating a developer falling position and a developer falling route.
Figure 5:
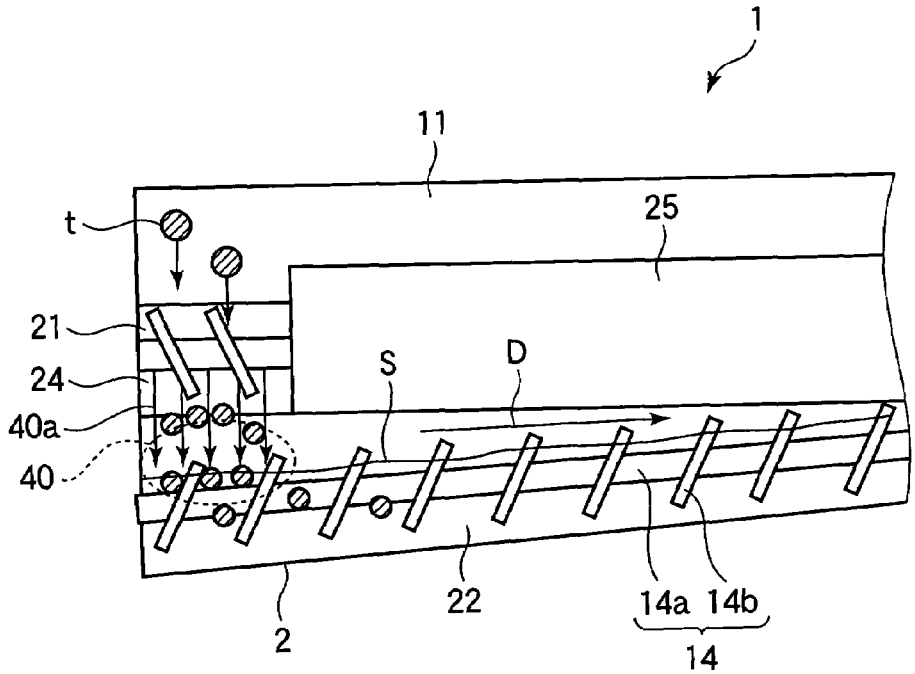
FIG. 5 is a lateral cross-sectional view of the developing apparatus in an agitating chamber for illustrating the developer falling position and the developer falling route.

The states of the developer and the toner to be supplied near the second communicating path 24 of the developing apparatus 1 will be further described with reference also to FIGS. 4 and 5. FIG. 4 shows a vertical cross section of the developing apparatus 1 taken in the second communicating path 24 along a direction orthogonal to the longitudinal direction of the developing sleeve 11. FIG. 5 shows a lateral cross section of the developing apparatus 1 taken in the agitating chamber 22 along the longitudinal direction of the developing sleeve 11.

As shown in FIGS. 4 and 5, the developer falls from the developing chamber 21 into the agitating chamber 22 through the second communicating path 24, whereby it is delivered from the developing chamber 21 to the agitating chamber 22. In the agitating chamber 22 near the second communicating path 24, there is a developer falling position 40 at which the developer falls from the developing chamber 21 into the agitating chamber 22. That is, in the agitating chamber 22, there is formed a developer falling route 40*a* along which the developer falls from the developing chamber 21 to the developer falling position 40 in the agitating chamber 22 through the second communicating path 24.

On the other hand, the toner "t" to be supplied is supplied from the developer supplying port 28 provided above the agitating chamber 22 (above the second screw 14) into the agitating chamber 22. This toner "t" to be supplied collides with the developer falling from the developing chamber 21 to the developer falling position 40 in the agitating chamber 22. That is, the toner "t" to be supplied falls from the developing chamber 21 onto the developer falling route 40*a* to the agitating chamber 22, and collides with the developer on this developer falling route 40*a*. The toner "t" to be supplied is fused by a shock occurring at this time, and thereafter falls onto the second screw 14. Further, the developer incessantly continues to fall from the developing chamber 12 onto the fused toner "t" to be supplied. Thereby, the toner "t" to be supplied is readily introduced into the developer.

As described above, in the present embodiment, the toner "t" to be supplied which is supplied from the developer supplying port 28 provided above the agitating chamber 22 is made to fall onto the developer falling route 40*a* in the agitating chamber 22, i.e., an area in which the communicating path 24 for the developer in the agitating chamber 22 from the developing chamber 21 to the agitating chamber 22 joins. Typically, the toner "t" to be supplied is made to fall from the developer supplying port 28 vertically above the developer falling position 40 in the agitating chamber 22 into the agitating chamber 22. Therefore, the introducibility and dispersibility of the toner "t" to be supplied into the developer are remarkably high.

Also, as described above, in the present embodiment, the bottom surface 21*a* of the developing chamber 21 is located vertically above the developer surface S in the agitating chamber 22, and the sealing action by the developer falling from the developing chamber 21 into the agitating chamber 22 works. Thus, it is very difficult for the toner immediately after supplied to flow back into the developing chamber 12.

Here, the principle of the present invention will be further described. To cause the supplied toner to be sufficiently frictionally charged with the carrier, the following three kinds of performance are generally necessary for the agitating chamber 22:

(1) The introducibility of the toner to be supplied into the developer;

(2) The dispersibility with which the toner to be supplied is fused; and (3) The mixability of the toner to be supplied with the carrier in the developer.

Each of these will hereinafter be described.

(1) Generally, the toner supply to the developing apparatus is often effected by a method of causing the toner to freely fall onto the developer circulating in the developer circulation route. In the case of this method, however, the toner to be supplied is liable to waft on the developer. To mix the toner to be supplied with the carrier in the developer it is first necessary to introduce the toner to be supplied wafting on the developer into the developer. Therefore, in an ordinary developing apparatus, the toner to be supplied is introduced into the developer by a so-called screw having a spiral member provided on the peripheral surface of the cylindrical shaft thereof. When it is contrived to further improve the introducibility, a quadrilateral or trapezoid member is sometimes additionally provided on the peripheral surface of the cylindrical shaft.

(2) Generally, for the stabilization of the accuracy of toner supply, a certain degree of pressure is often given to the toner immediately before supplied to the developing apparatus to thereby bring about a state in which the toner has been condensed to a certain degree, and thereafter supply the toner. Accordingly, to uniformly mix the toner to be supplied with the carrier in the developer, it is necessary to fuse and disperse the toner being in this state condensed to a certain degree.

Therefore, in the ordinary developing apparatus, the supplied toner is fused and dispersed by the above-described screw.

(3) To sufficiently charge the toner, it is necessary to perform the mixing operation positively so that much of the toner and the carrier may be brought into contact with each other. Therefore, in the ordinary developing apparatus, the mixing of the supplied toner and the carrier is effected by the above-described screw.

Figure 12:
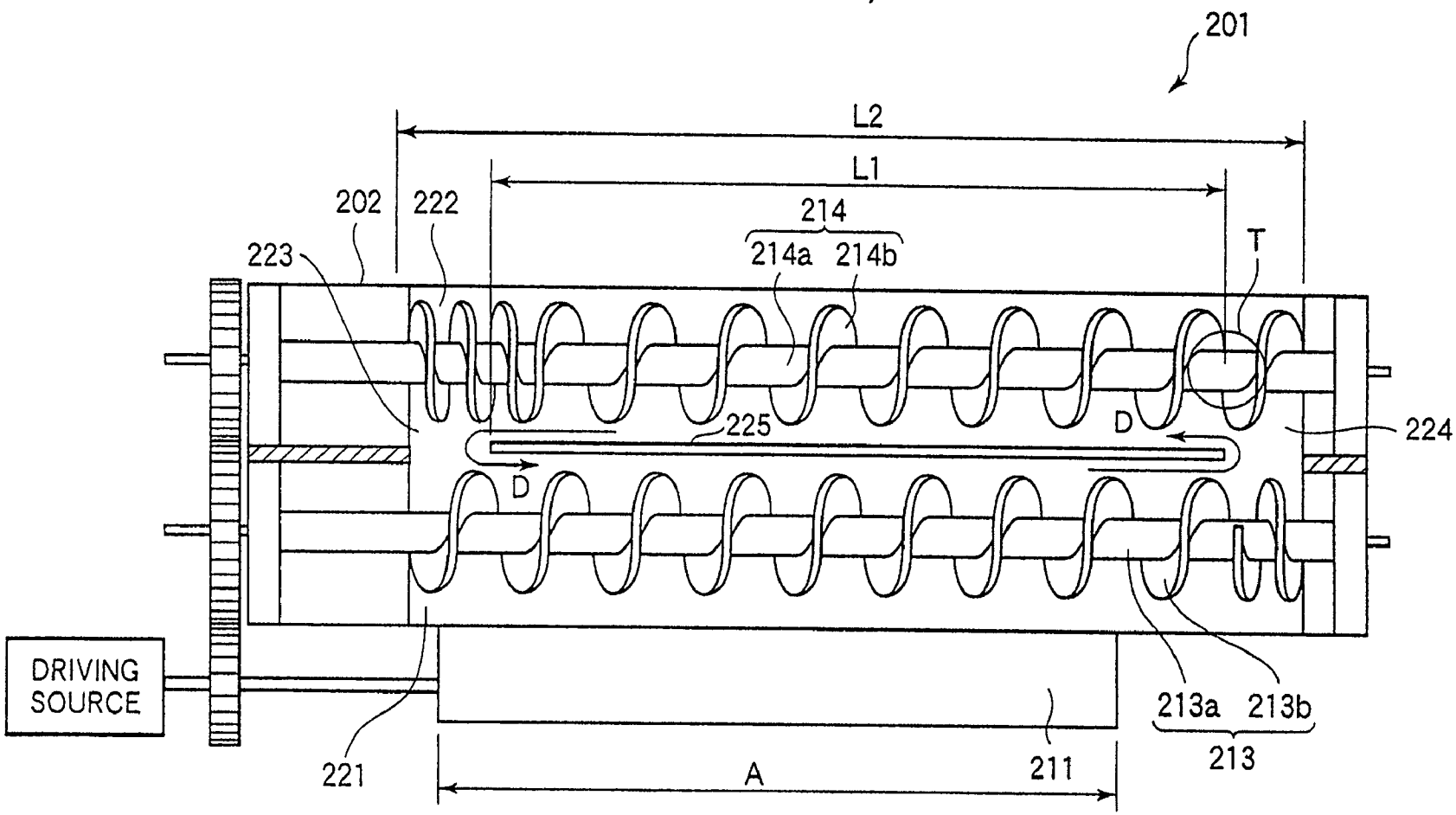
FIG. 12 (Prior Art)
FIG. 12 is a top plan view of an example of a conventional developing apparatus.

To sufficiently charge the supplied toner, it is necessary to satisfy these three kinds of performance by the screw, but in the conventional developing apparatus, the introducibility and dispersibility of the toner to be supplied into the developer-are low, and this has often led to a construction in which the agitating distance L1 becomes longer than the image formable width A (see, for example, FIG. 12).

In view of the above-noted problem, in the present embodiment, in the second communicating path 24 through which the developer is delivered from the developing chamber 21 to the agitating chamber 22, the bottom surface 21*a* of the developing chamber 21 is located vertically above the developer surface S in the agitating chamber 22, whereby the developer falling position 40 onto which the developer falls is provided in the agitating chamber 22. Thus, there is adopted a construction in which the toner to be supplied falls onto the developer falling route 40*a* along which the developer falls from the developing chamber 21 to the developer falling position 40 in the agitating chamber 22, i.e., the area in which the communicating path 24 for the developer from the developing chamber 21 to the agitating chamber 22, in the agitating chamber 22, joins. Thereby, it becomes possible to achieve remarkable improvements in the introducibility and dispersibility of the toner to be supplied into the developer.

More specifically, the toner to be supplied is easily fused by a shock produced when the toner to be supplied collides with the developer falling from the developing chamber 21 to the developer falling position 40 in the agitating chamber 22. Further, the developer incessantly continues to fall from the developing chamber 21 also onto the fused toner to be supplied. Thereby, the toner to be supplied is readily introduced into the developer.

In addition, in the present embodiment, the bottom surface 21*a* of the developing chamber 21 is vertically above the developer surface S in the agitating chamber 22. Thereby, the toner to be supplied hardly flows back into the developing chamber 21. That is, the toner supplied into the agitating chamber 22 hardly scatters into the developing chamber 21 against the direction of gravity. Further, the back flow toner is sealed by the developer falling from the developing chamber 21 to the agitating chamber 22.

Figure 13:
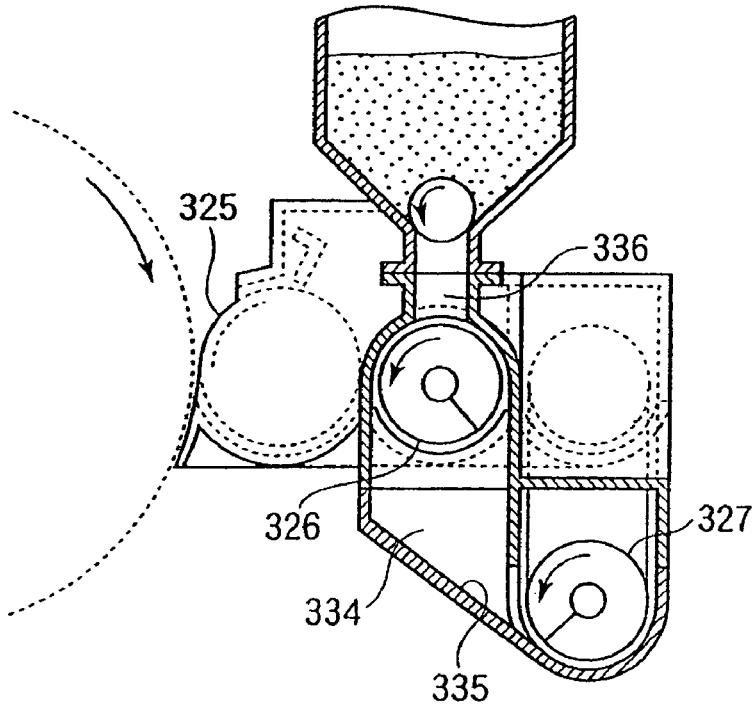
FIG. 13 (Prior Art)
FIG. 13 is a vertical cross-sectional view of another example of the conventional developing apparatus.
Figure 14:
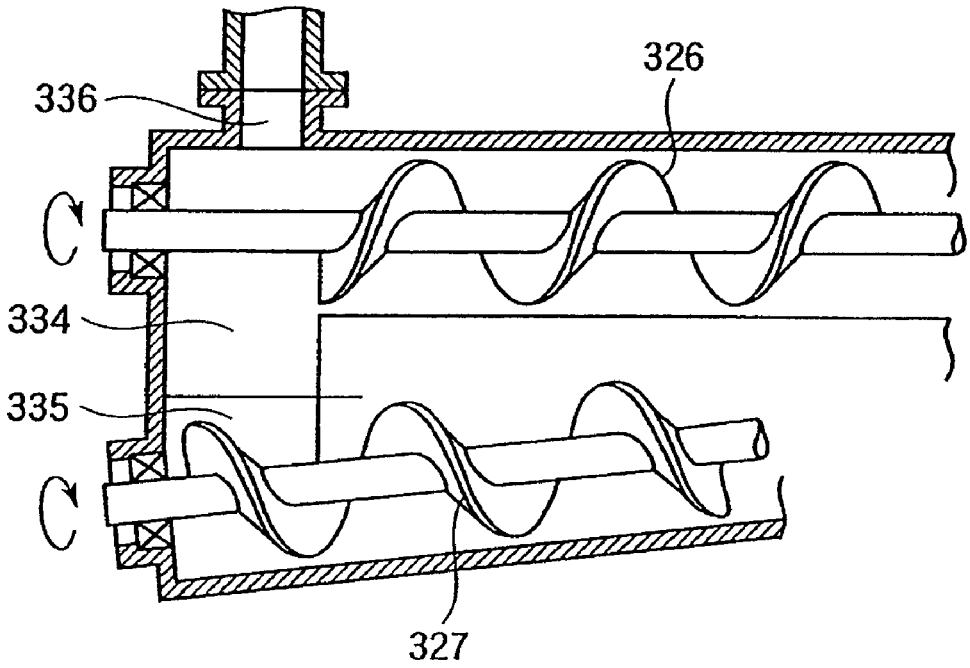
FIG. 14 (Prior Art)
FIG. 14 is a lateral cross-sectional view of the vicinity of the developer delivering portion of the conventional developing apparatus shown in FIG. 13.

Also, according to the present embodiment, the toner to be supplied does not fall onto the first screw 13, but directly falls onto the developer falling route 40*a* in the agitating chamber 22. Accordingly, unlike a developing device proposed in Japanese Patent Application Laid-Open No. 2003-5519 (shown in FIGS. 13 and 14), the toner to be supplied does not scatter toward the upstream side with respect to the developer conveying direction in the developing chamber 21, and even if the longitudinal conveying distance L2 is substantially equal to the image formable width A, toner fog can be reliably prevented from being caused in the image blank portion by the toner not sufficiently charged.

Thus, according to the present embodiment, in spite of the longitudinal conveying distance L2 being substantially equal to the image formable width A, the introducibility and dispersibility of the toner to be supplied into the developer are remarkably high and therefore, it is possible to greatly shorten the agitating distance L1. Also, according to the present embodiment, the phenomenon of the toner to be supplied flowing back to the developing chamber 21 can be prevented and therefore, even if the longitudinal conveying distance L2 is substantially equal to the image formable width A, toner fog is not caused in the image blank portion by the toner not sufficiently charged.

That is, according to the present embodiment, in the developing apparatus 1 wherein the two-component developer is circulated between the developing chamber 21 and the agitating chamber 22, the toner chargeability in the agitating chamber 22 is improved and the back flow of the toner to be supplied to the developing chamber 21 is prevented, whereby toner fog can be prevented even if the longitudinal conveying distance L2 is substantially equal to the image formable width A.

The charge imparting property to the toner to be supplied and the prevention of the back flow of the toner to be supplied to the developing chamber 21 in the developing apparatus 1 according to the present embodiment will hereinafter be described in greater detail in accordance with the results of experiments.

[Experimental Example 1 ]

Figure 6:
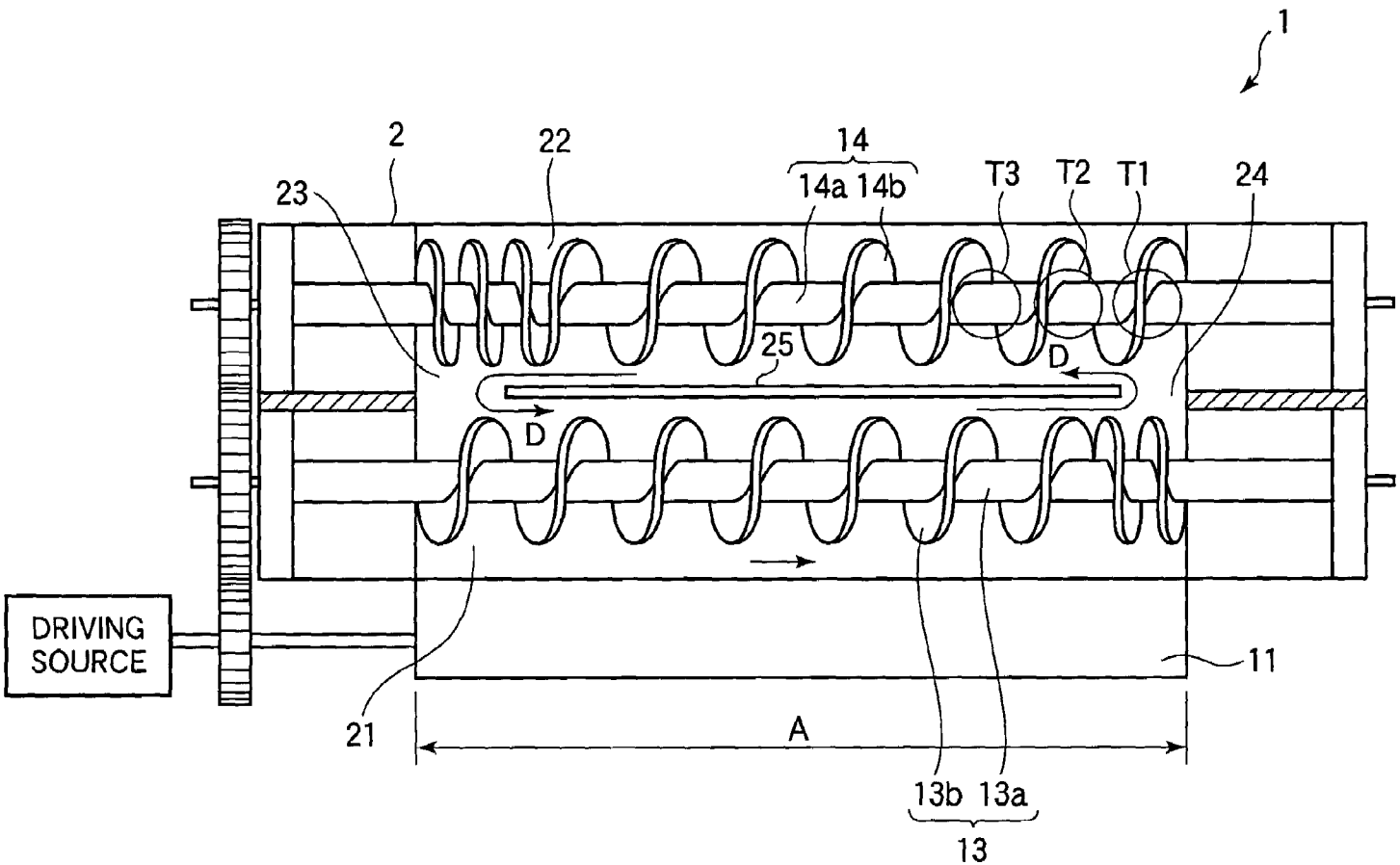
FIG. 6 is a top plan view of the developing apparatus for illustrating the experimental condition of Experimental Example 1.
Figure 7:
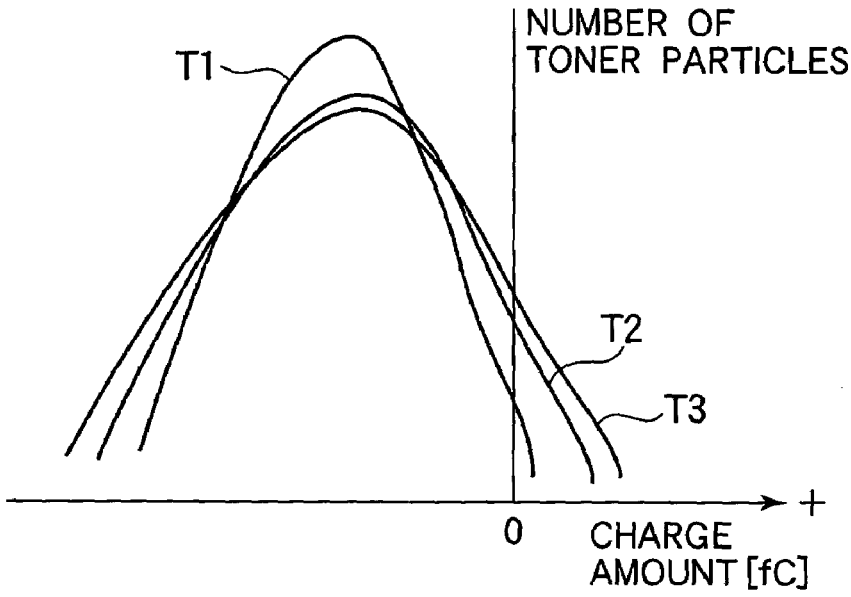
FIG. 7 is a graph showing the experimental result of Experimental Example 1.

In this experimental example, 1 g of toner was supplied at toner supplying positions T1-T3 shown in FIG. 6, and the charge amount of this supplied toner in the first communicating path 23 was measured. FIG. 7 shows the distribution of the charge amount. The positional relation among the toner supplying positions T1-T3 is as follows. The constructions of the developing apparatus were all substantially the same with the exception that the toner supplying positions (T1-T3) differed from one another.

T1: The toner supplying position in the developing apparatus 1 according to the present embodiment (on the developer falling route in the agitating chamber)

T2: 10 mm downstream of T1

T3: 20 mm downstream of T1

The chargeability of the toner in FIG. 7 was measured by measuring the charge amount (fC) of 3,000 toner particles by E-Spart Analyzer produced by HOSOKAWA MICRON Corp. When all of the toner particles are of the negative polarity, it can be said that the charge imparting property to the toner is good. Also, when the toner is not frictionally charged (the charge amount is zero) or there exist toner particles assuming the positive polarity, the charge imparting property to the toner is inferior.

The toner of the toner fog occurring in the image blank portion, as is well known, is a toner of the opposite polarity (in the present example, the positive polarity) to the regular charging polarity (in the present example, the negative polarity) of the toner, or a toner of which the charge amount is zero. Accordingly, if all of the supplied toner is of the regular charging polarity (in the present example, the negative polarity) in the first communicating path 23, toner fog will hardly occur.

As can be seen from the distribution of the toner charge amount shown in FIG. 7, at the toner supplying positions T2 and T3, there exist a number of toner particles of the positive polarity or of which the charge amount is zero.

In contrast, it will be seen that at the toner supplying position TV in the present embodiment, there exists little or no toner particle of the positive polarity or of which the charge amount is zero. This is considered to be because in the developing apparatus 1 according to the present embodiment, the charge imparting property to the toner has been improved owing to the principle as described above. That is in the developer falling route 40*a* through which the developer falls from the developing chamber 21 to the developer falling position 40 in the agitating chamber 22 through the second communicating path 24, the toner to be supplied is fused by a shock produced during the collision thereof with the developer falling from the developing chamber 21 to the agitating chamber 22. Further, the developer incessantly continues to fall from the developing chamber 21 onto the fused toner to be supplied. Thereby, the toner to be supplied is readily introduced into the developer and becomes readily frictionally charged with the carrier.

[Experimental Example 2 ]

Figure 8:
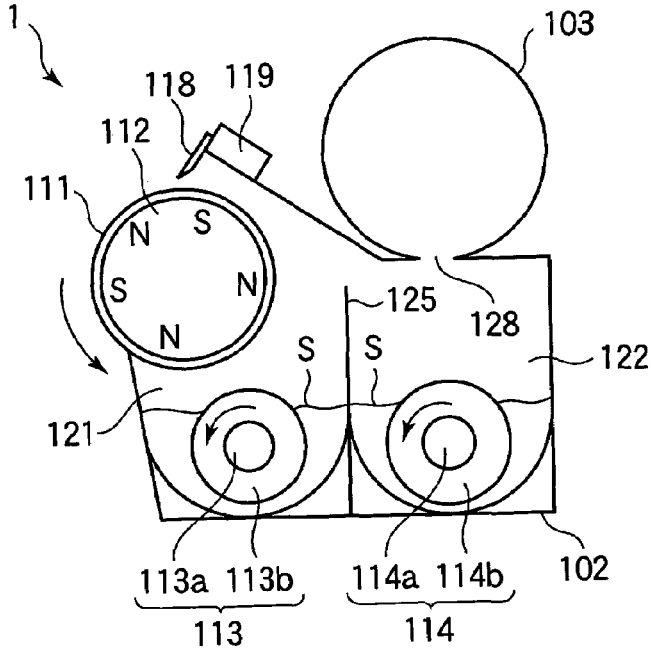
FIG. 8 is a schematic cross-sectional view of a developing apparatus according to a comparative example.
Figure 9:
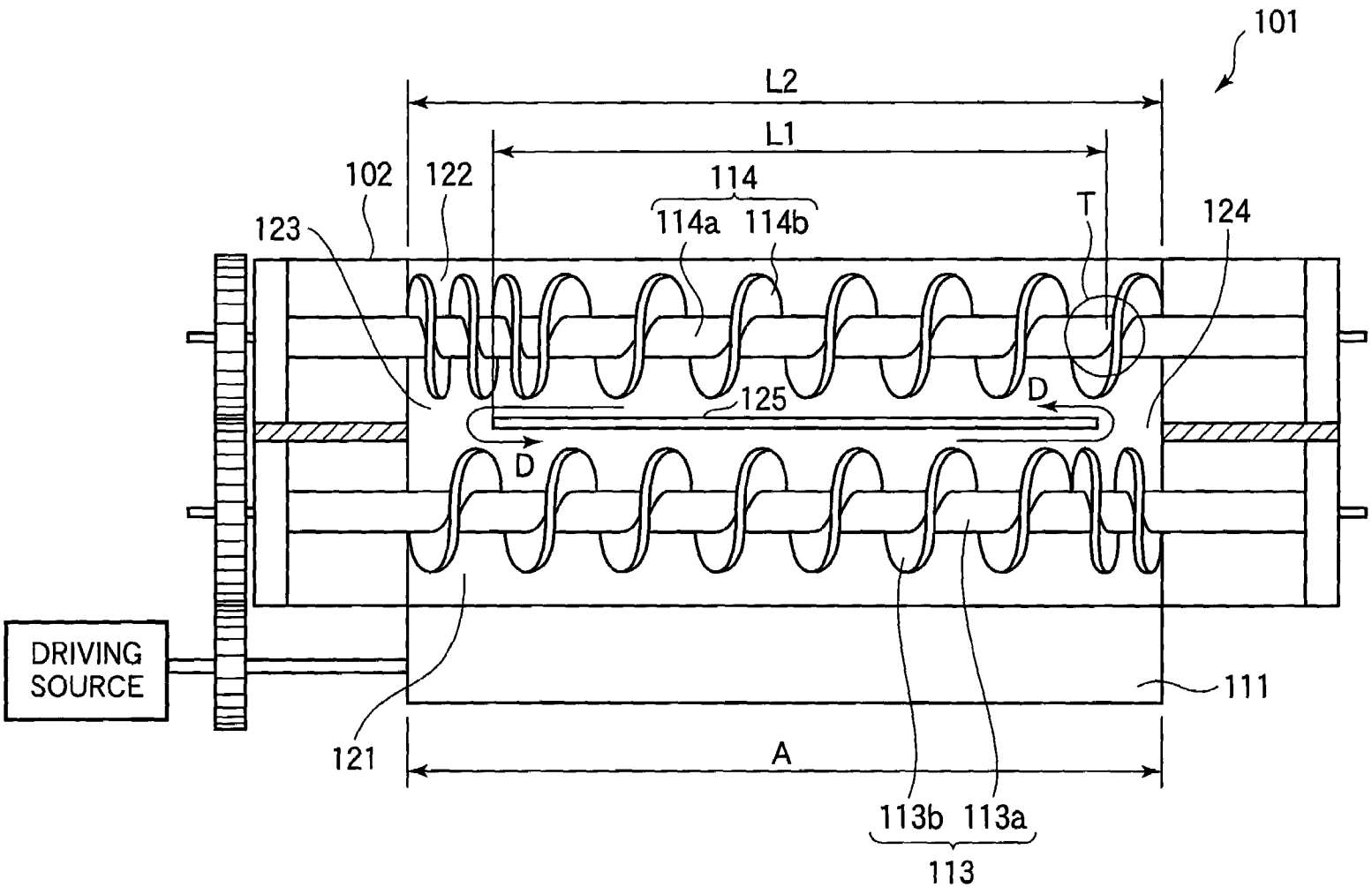
FIG. 9 is a schematic top plan view of the developing apparatus according to the comparative example.

This experimental example compares the developing apparatus 1 according to the present embodiment with a developing apparatus 101 according to a comparative example shown in FIGS. 8 and 9.

In the developing apparatus 101 according to the comparative example shown in FIGS. 8 and 9, the longitudinal conveying distance L2 is the same as that in the developing apparatus 1 according to the present embodiment, but as agitating chamber 122 is horizontally disposed and the bottom surface 122*a* of the agitating chamber 122 is vertically at the same height as the bottom surface 121*a* of a developing chamber 121. Accordingly, in the developing apparatus 101 according to the comparative example, the developer does not fall from the developing chamber 121 to the agitating chamber 122 through a second communicating path 124, and as a matter of course, a developer falling position and a developer falling route in the agitating chamber 122 are not formed. Except the above-noted points the developing apparatus 101 according to the comparative example had substantially the same construction as the developing apparatus 1 according to the present embodiment. In the developing apparatus 101 according to the comparative example shown in FIGS. 8 and 9, elements functionally and structurally substantially identical with or corresponding to those in the developing apparatus 1 according to the present embodiment are given the same reference numerals suffixed to 100.

Figure 10:
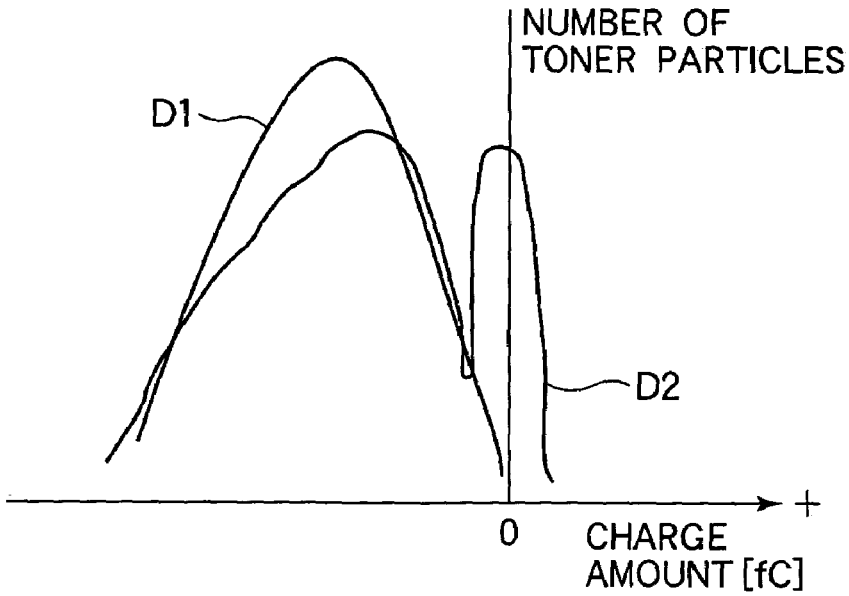
FIG. 10 is a graph showing the experimental result of Experimental Example 2.

In the developing apparatus 1 according to the present embodiment and the developing apparatus 101 according to the comparative example, 1 g of toner was supplied at the shown toner supplying position T (i.e., in the developing apparatus 1 according to the present embodiment, vertically above the developer falling position 40 (FIG. 3), and in the developing apparatus 101 according to the comparative example, the same position as that in the developing apparatus 1 according to the present embodiment in the longitudinal direction of the agitating chamber 122 (FIG. 9)). Immediately thereafter, the toner charge amounts in the developing chambers 21 and 121 in the second communicating paths 24 and 124 were measured. FIG. 10 shows the distributions of the charge amounts. In FIG. 10, a plot D1 indicates the distribution of the toner charge amount in the developing apparatus 1 according to the present embodiment, and a plot D2 indicates the distribution of the toner charge amount in the developing apparatus 101 according to the comparative example. The method of measuring the distributions of the toner charge amounts in the present experimental example is the same as that in the foregoing Experimental Example 1.

As can be seen from the distributions of the toner charge amounts shown in FIG. 10, in the developing apparatus 101 according to the comparative example, there exist a number of toner particles of which the charge amount is in the vicinity of zero.

In contrast, in the developing apparatus 1 according to the present embodiment, it will be seen that there is little or no toner particle of the positive polarity or of which the charge amount is zero. This is considered to be because in the developing apparatus 1 according to the present embodiment, the toner immediately after supplied can be prevented from flowing back to the developing chamber 21, owing to the principle as described above. That is, in the developing apparatus 1 according to the present embodiment, near the second communicating path 24, the bottom surface 21*a* of the developing chamber 21 is located vertically above the developer surface S in the agitating chamber 22, and the sealing action of the developer failing from the developing chamber 21 to the agitating chamber 22 works. Thus, the toner immediately after supplied of which the charge amount is nearly zero hardly flows back into the developing chamber 21.

As is apparent from the above-described Experimental Example 1 and Experimental Example 2, in the developing apparatus 1 according to the present embodiment, in spite of the longitudinal conveying distance L2 being substantially equal to the image formable width A, the introducibility and dispersibility of the toner to be supplied are remarkably high and therefore, it becomes possible to greatly shorten the agitating distance L1. Also, according to the developing apparatus 1 according to the present embodiment, the phenomenon of the toner to be supplied flowing back to the developing chamber 21 can be prevented and therefore, even if the longitudinal conveying distance L2 is substantially equal to the image formable width A, it will never happen that toner fog is caused in the image blank portion by the toner not sufficiently charged.

As described above, according to the present embodiment, the toner chargeability in the agitating chamber 22 is improved and it becomes possible to prevent the back flow of the toner to be supplied. Thereby, toner fog can be prevented even if the longitudinal conveying distance L2 is substantially equal to the image formable width A. Thus, according to the present embodiment, it becomes possible to minimize the longitudinal distance of the developer circulation route in the developer container 2, and the developing apparatus 1 can be correspondingly downsized. Also, according to the present embodiment, correspondingly to the shortening of the longitudinal conveying distance L2 in the developing apparatus 1, the downsizing of the image forming apparatus 100 can be achieved as compared with the conventional image forming apparatus.

Embodiment 2

Another embodiment of the present invention will now be described. An image forming apparatus according to the present embodiment permits a process cartridge to be detachably mounted thereon as a cartridge detachably mountable on an image forming apparatus main body 10. The basic construction and operation of the image forming apparatus according to the present embodiment are the same as those of Embodiment 1. Accordingly, elements functionally and structurally substantially identical with or corresponding to those of the image forming apparatus according to Embodiment 1 are given the same reference characters and need not be described in detail.

Figure 11:
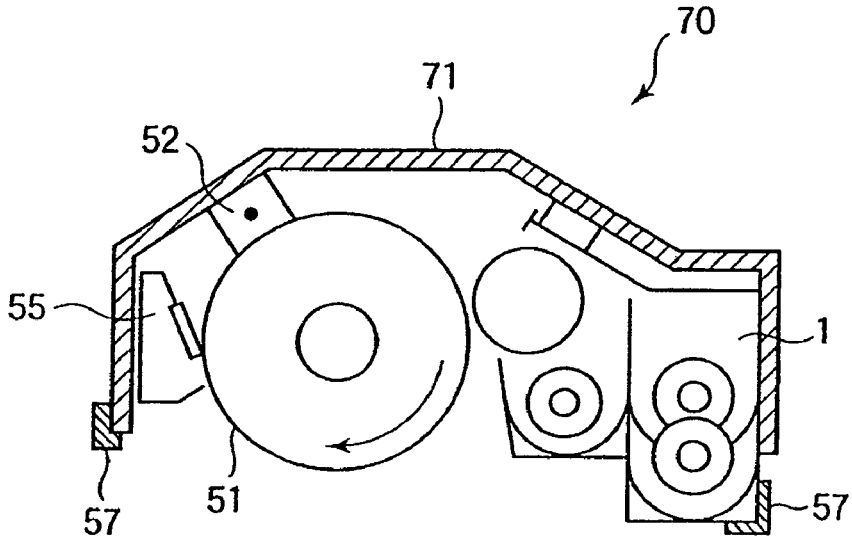
FIG. 11 is a schematic cross-sectional view of an embodiment of a cartridge according to the present invention.

FIG. 11 schematically shows a cross section of a process cartridge 70 in the present embodiment. The process cartridge 70 in the present embodiment has a photosensitive drum 51, a primary charger 52, a cleaning apparatus 55 and a developing apparatus 1 constructed integrally with one another by a frame member 71. Here, the construction of the developing apparatus 1 is the same as that described in Embodiment 1.

The process cartridge 70 is detachably mounted on the image forming apparatus main body 10 through cartridge mounting means 57 such as a mounting guide and a positioning member provided in the image forming apparatus main body 10.

Generally, the process cartridge 70 is entirely taken out of the image forming apparatus main body 10 when the photosensitive drum 51 has reached the end of its life or the developer in the developing apparatus 1 has been remarkably deteriorated. Then, a new process cartridge 70 is mounted on the image forming apparatus main body 1, whereby the image forming apparatus can be restored to its original state. Thereby, it becomes possible to achieve an improvement in maintenance property. Also, owing to this high maintenance property, maintenance can be done by a user himself without resort to a serviceman having technical knowledge of instrument interchange. Thus, it becomes possible to reduce the running cost of the image forming apparatus by a reduction in labor cost.

The process cartridge 70 in the present embodiment is of the same construction as that in Embodiment 1. Thus, according to the present embodiment, an effect similar to that of Embodiment 1 can be obtained and particularly in the present embodiment, correspondingly to the shortening of the longitudinal conveying distance L2 of the developing apparatus 1, the downsizing of the process cartridge 70 can be achieved as compared with a conventional process cartridge.

The construction of the process cartridge is not restricted to that of the above-described embodiment. That is, the construction of the process cartridge can be suitably determined with the user's maintenance property and the life of each element taken into account, and it will be good if an electrophotographic photosensitive member and at least one of charging means, developing means and cleaning means as process means for acting on the electrophotographic photosensitive member are integrally made into a cartridge, which is made detachably mountable on the image forming apparatus main body. Also, a cartridge detachably mountable on the image forming apparatus main body is not restricted to the above-described process cartridge, but may be made into a unit (developing cartridge) in which the developing apparatus is singly detachably mounted on the image forming apparatus main body. Again in this case, as in the above-described embodiment, the downsizing of the developing cartridge can be achieved.

As described above, according to the present embodiment, the toner chargeability in the agitating chamber 22 of the developing apparatus 1 is improved and it is possible to prevent the toner to be supplied from flowing back into the developing chamber 21 and therefore, toner fog can be prevented even if the longitudinal conveying distance L2 is substantially equal to the image formable width A. thereby, there can be provided a compact process cartridge as compared with a conventional one.

While the present invention has hitherto been described with respect to the specific embodiments thereof, each of the above-described embodiments is merely an example for carrying out the present invention, and the present invention is not intended to be restricted to the modes of the above-described embodiments. In the light of the foregoing description and the scope of the appended claims various changes and modifications of the constructions of the developing apparatus, the cartridge and the image forming apparatus are possible without departing from the spirit of the present invention.

For example, in the developing apparatus 1 according to the present embodiment, the inclination of the agitating chamber 22 is 5 degrees, but the present invention is not particularly restricted to this angle. The inclination can be an angle by which smooth developer circulation is achieved and yet, a developer falling position in the agitating chamber 22 and a developer falling route from the developing chamber 21 to the agitating chamber 22 are formed.

Also, the toner and the carrier are not restricted to those used in each of the above-described embodiments. Also, while in the above-described embodiments, it has been described that an amount of toner corresponding to the amount consumed by image forming is supplied to the developer container 2, the present invention is not restricted thereto. For example, there is a method of discharging a small amount of carrier from the developer container 2 each time, and interchanging the deteriorated carrier with a fresh carrier. In such a case, the carrier can also be supplied together with the toner. Again in this case, the toner to be supplied in the developer to be supplied is readily fused by the collision thereof with the developer in the developer falling route.

This application claims priority from Japanese Patent Application No. 2004-231745 filed on Aug. 6, 2004, which is hereby incorporated by reference herein.

What is claimed is:

1. A developing apparatus comprising:

a developer carrying member for carrying thereon and conveying a developer including a toner and a carrier to a portion opposed to an image bearing member;

a first chamber having said developer carrying member disposed in an opening thereof;

a conveying member disposed in said first chamber for conveying the developer in a longitudinal direction of said developer carrying member;

a second chamber to which the developer is supplied from said first chamber through a first communicating portion leading to said first chamber and which supplies the developer to said first chamber through a second communicating portion leading to said first chamber;

an agitating and conveying member disposed in said second chamber and rotatable to thereby agitate and convey the developer, wherein said second chamber and said agitating and conveying member are disposed while being inclined with respect to a horizontal direction so that a side of said second communicating portion thereof is higher than a side of said first communicating portion thereof, wherein a side of said first communicating portion of said first chamber is higher than the side of said first communicating portion of said second chamber; and a developer supplying device for directly supplying a developer to be supplied, from just above an area of said second chamber, to which the developer supplied from said first communicating portion joins.

2. A developing apparatus according to claim 1, wherein a longitudinal length of said second chamber is substantially equal to a longitudinal maximum length of a maximum image formable area on the image bearing member.

3. A developing apparatus according to claim 1 or 2, wherein said agitating and conveying member includes a rotary shaft and a spiral conveying portion on a peripheral surface of said rotary shaft.

* * * * *

UNITED STATES PATENT AND TRADEMARK OFFICE

CERTIFICATE OF CORRECTION

PATENT NO. : 7,426,360 B2
APPLICATION NO. : 11/193398
DATED : September 16, 2008
INVENTOR(S) : Kota Arimoto et al.

It is certified that error appears in the above-identified patent and that said Letters Patent is hereby corrected as shown below:

COLUMN 2:
Line 24, “binders” should read --binds--.
Line 25, “further” should read --furthers--.

COLUMN 5:
Line 18, “member a” should read --members,--.
Line 27, “(exposing means)” should read --(exposing means).--.

COLUMN 6:
Line 26, “an” should read --a--.

COLUMN 7:
Line 6, “agitated-by” should read --agitated by--.
Line 51, “suitable” should read --suitably--.

COLUMN 8:
Line 20, “counter-clockwise” should read --counterclockwise--.

COLUMN 10:
Line 32, “supplied” should read --being supplied--.
Line 62, “supplied” should read --being supplied--.

COLUMN 11:
Line 13, “oper-are” should read --oper are--.

COLUMN 12:
Line 58, “exist” should read --exists--.

COLUMN 13:
Line 62, “exist” should read --exists--.

UNITED STATES PATENT AND TRADEMARK OFFICE

CERTIFICATE OF CORRECTION

PATENT NO. : 7,426,360 B2
APPLICATION NO. : 11/193398
DATED : September 16, 2008
INVENTOR(S) : Kota Arimoto et al.

It is certified that error appears in the above-identified patent and that said Letters Patent is hereby corrected as shown below:

COLUMN 14:

Line 3, “supplied” should read --being supplied--.
Line 12, “supplied” should read --being supplied,--; and “zero” should read --zero,--.
Line 39, “correspondingly” should read --corresponding--.

COLUMN 15:

Line 22, “correspondingly” should read --corresponding--.

Signed and Sealed this

Twenty-fourth Day of March, 2009

JOHN DOLL
*Acting Director of the United States Patent and Trademark Office*